US006035687A

United States Patent [19]

Grimmel et al.

[11] Patent Number: 6,035,687

[45] Date of Patent: Mar. 14, 2000

[54] ROLLING MILL STAND FOR ROLLING WIRE

[75] Inventors: Rüdiger Grimmel, Netphen; Karl Keller, Hilchenbach, both of Germany

[73] Assignee: SMS Schloemann-Siemag Aktiengesellschaft, Dusseldorf, Germany

[21] Appl. No.: 09/226,821

[22] Filed: Jan. 6, 1999

[30] Foreign Application Priority Data

Jan. 7, 1998 [DE] Germany ..... 198 00 201

[51] Int. Cl.[7] ..... B21B 31/32

[52] U.S. Cl. ..... 72/245

[58] Field of Search ..... 72/240, 245, 248, 72/249, 237

[56] References Cited

U.S. PATENT DOCUMENTS

| | | | |
|---|---|---|---|
| 3,468,151 | 9/1969 | Diolot | 72/245 |
| 5,345,800 | 9/1994 | Smith et al. | 72/90 |
| 5,896,771 | 4/1999 | Muller et al. | 72/240 |

*Primary Examiner*—Rodney Butler
*Attorney, Agent, or Firm*—Brown & Wood, LLP

[57] ABSTRACT

A rolling mill stand for rolling wire and including a frame, at least one chock mounted in the frame and having a roll-side bearing and a thrust bearing, a roll support shaft supported in the roll-side bearing and the thrust bearing and projecting outwardly past the roll-side bearing so that a roll can be mounted on a projecting portion of the support shaft, and a hydraulic cylinder unit for adjusting the roll support shaft relative to a further roll support shaft supported in the frame in an adjusting direction and having a cylinder connected with the frame and a piston connected with the chock.

8 Claims, 4 Drawing Sheets

1'
13
11
12
1
14
2
5
6
9

15
15
16
16
1'
13
11
12
14
1
2
5
6
22
23
9

ROLLING MILL STAND FOR ROLLING WIRE

BACKGROUND OF THE INVENTION

1. Field of the Invention

The present invention relates to a rolling mill stand for rolling wire and including a frame, at least one chock mounted in the frame and having a roll-side bearing and a thrust bearing; a roll support shaft supported in the roll-side bearing and the thrust bearing and projecting outwardly past the roll-side bearing so that a roll can be mounted on a projecting portion of the support shaft, and an adjusting device for adjusting the roll support shaft relative to a further roll support shaft supported in the frame in an adjusting direction.

2. Description of the Prior Art

Such rolling mill stands are well known. However, the adjustment of the roll support shafts with conventional adjusting devices is not sufficiently precise, is rather complicated, and is not sufficiently reliable.

Accordingly, an object of the present invention is to provide a rolling mill stand of the above-described type with an adjusting device which would insure a simple, reliable and cost-effective adjustment of two roll support shaft relative to each other.

SUMMARY OF THE INVENTION

This and other objects of the present invention, which will become apparent hereinafter, are achieved by forming the adjusting device as a hydraulic cylinder unit the cylinder of which is connected with the frame and the piston of which is connected with the chock.

According to a preferred embodiment of the present invention, the piston of the adjusting cylinder unit is releasably connected with the chock, which insures an easy dismounting of the adjusting hydraulic cylinder unit and/or the chock.

The releasable connection of the piston with the chock is constructively effected in a particularly simple manner when the piston has at least one through-bore which is aligned with a threaded bore formed in the chock, with a dowel screw being screwed into the threaded bore of the chock and having a portion projecting through the through-bore formed in the piston beyond the piston, with a nut being screwed onto the projecting portion.

The guiding of the piston is particularly easily effected when piston guide, in particular a slide bearing is provided in the frame on a side of the adjusting hydraulic cylinder unit adjacent to the chock and, preferably, another slide bearing is provided on a side of the hydraulic cylinder unit remote from the chock.

Rotation of the chock about an axis extending parallel to the adjusting direction is particularly reliably prevented when the chock is supported in the frame in the region of the roll-side bearing transverse to an axis of the roll support shaft and transverse to the adjusting direction, and without a backlash.

A particularly reliable adjustment takes place when the adjusting hydraulic cylinder unit is located adjacent to the roll-side bearing.

Tilting of the disc roll supported on the roll support shaft is prevented in a particular simple manner when a compensating hydraulic cylinder unit is provided adjacent to the thrust bearing and has a cylinder connected with the frame and a piston connected with a further chock.

The costs of the rolling mill stand are reduced when the compensating hydraulic cylinder unit has smaller dimensions than the adjusting hydraulic cylinder unit.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
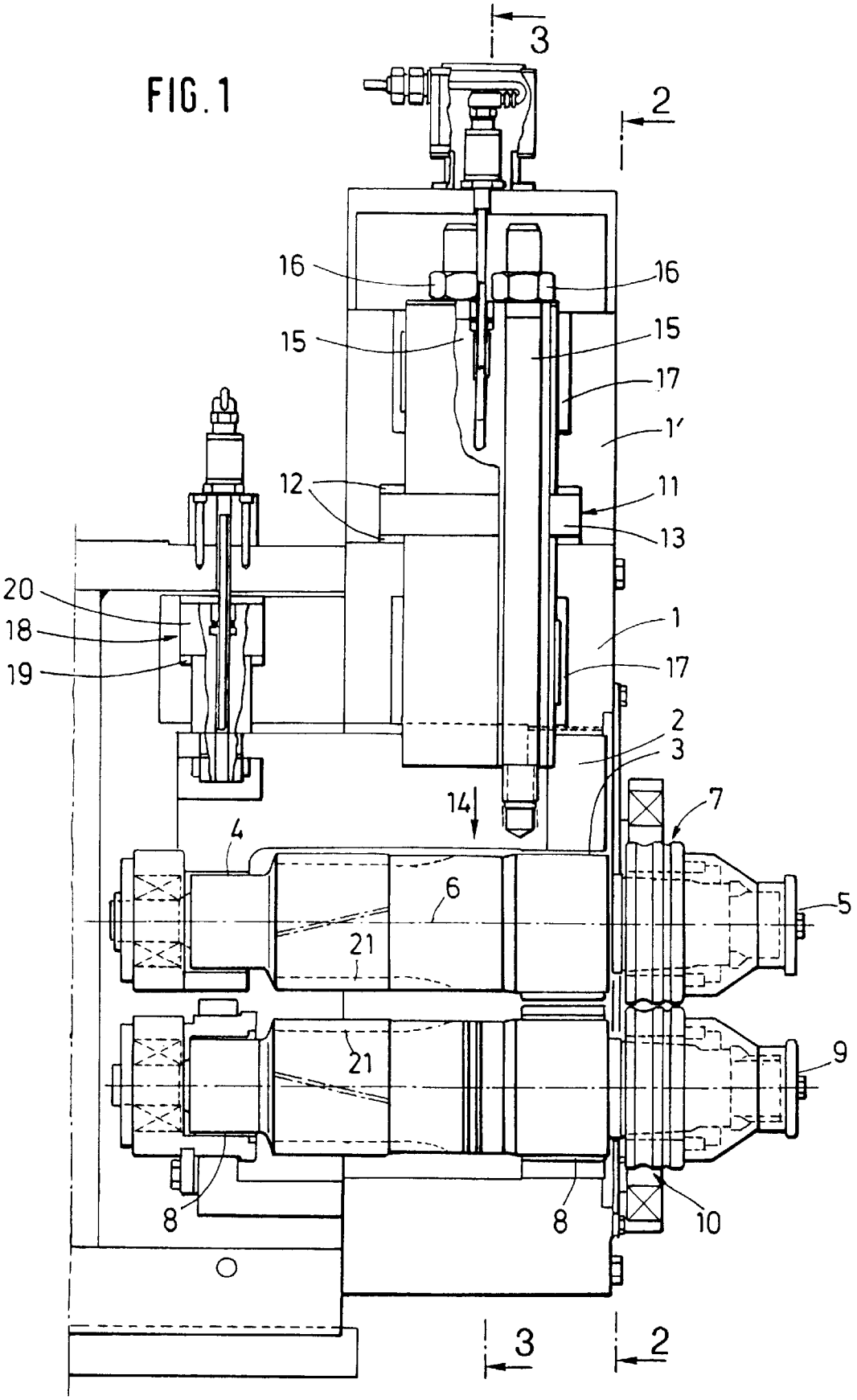
FIG. 1 shows a cross-sectional view of a rolling mill stand according to the present invention along the shaft axis and the adjustment direction.

A rolling mill stand according to the present invention for rolling wire, which is shown in the drawings, in particular in FIG. 1, has a frame 1 in which a one-piece chock 2 is mounted. The chock 2 includes a roll-side bearing 3 and a thrust bearing 4 in which a roll support shaft 5 having an axis 6 is supported. The support shaft 5 projects outwardly past the roll-side bearing 3 so that a disc roll 7 can be mounted on the support shaft 5 from outside.

The frame 1 further includes two further bearings 8 in which a further roll support shaft 9 is supported. The support shaft 9 likewise projects outwardly past the roll-side bearing 8, so that a further disc roll 10 can be mounted on further support shaft 8 from outside. The disc rolls 7 and 10 form together a roll clearance for a to-be-rolled wire.

The roll support shaft 5 is adjustable relative to the further roll support shaft 9. To this end, the rolling mill stand is provided with a hydraulic cylinder unit 11 with a cylinder 12 and a piston 13. The cylinder 12 is connected with the frame 1. In the embodiment shown in the drawings, the cylinder 12 is formed by the frame 1 and a cylinder upper part $1^1$. The piston 13 is connected with the chock 2. Thereby, the displacement of the piston 13 within the cylinder 12 in the adjustment direction 14 provides for the adjustment of the support shaft 5 relative to the further support shaft 9.

The adjusting hydraulic cylinder unit 11 is pressure-and position-controlled. Thus, a predetermined roll clearance can be exactly obtained not only by the position-control of the adjusting hydraulic cylinder unit 11. Also, the pressure-control permits to compensate the frame springing of the rolling mill stand which takes place upon application of rolling forces to the wire.

Figure 4:
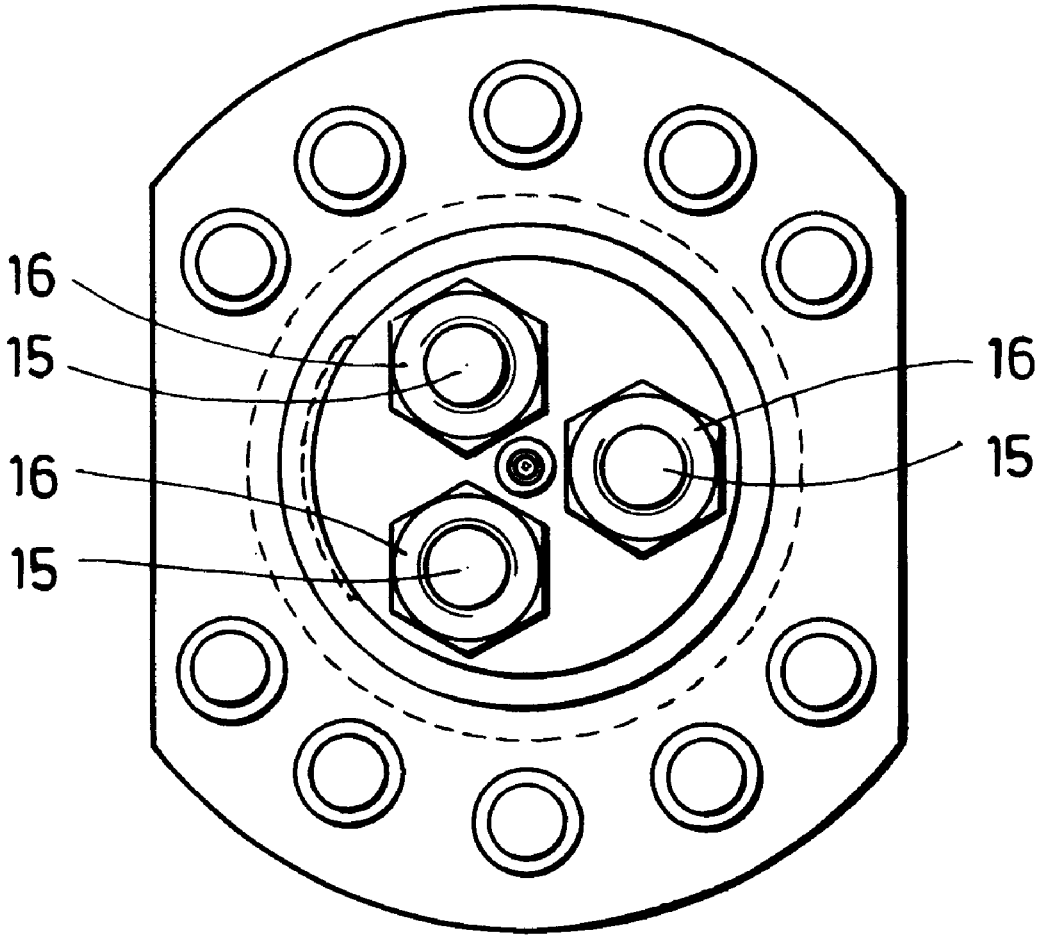
FIG. 4 shows a plan view of the hydraulic cylinder unit used in a rolling mill stand according to the present invention.

According to FIGS. 1 and 4, the piston 13 has three through-bores. The chock 2 has three corresponding threaded bores. The through-bores of the piston 13 and the threaded bores of the chock 2 are respectively aligned with each other. Dowel screws 15 are screwed into the threaded bores of the chock 15. The dowel screw 15 project above the piston 13. Nuts 16 are screwed on the projecting portions of the dowel screws 15. The dowel screw 15 and the nuts 16 releasably connect the piston 13 with the chock 2 in a very simple manner.

As shown in the drawings, the piston 13 is connected with the chock 2 by three dowel screws 15. Of course, a different number of dowel screws 15 can be used. Even a single dowel screw 15 may be sufficient. At that, the piston 13 is so connected with the chock 2 that both pressure forces and tension forces are transmitted to the chock 2.

To provide for an exact displacement of the piston 13 in the adjusting direction 14, there is provided in the frame 1 a slide bearing 17 in which the piston 13 is displaced. As can be seen in FIG. 1, there are provided two slide bearings 17, one on a side of the adjusting hydraulic cylinder unit 11 which is adjacent to the chock 2, and one on a side of the adjusting hydraulic cylinder unit 11 remote from the chock 2.

Figure 2:
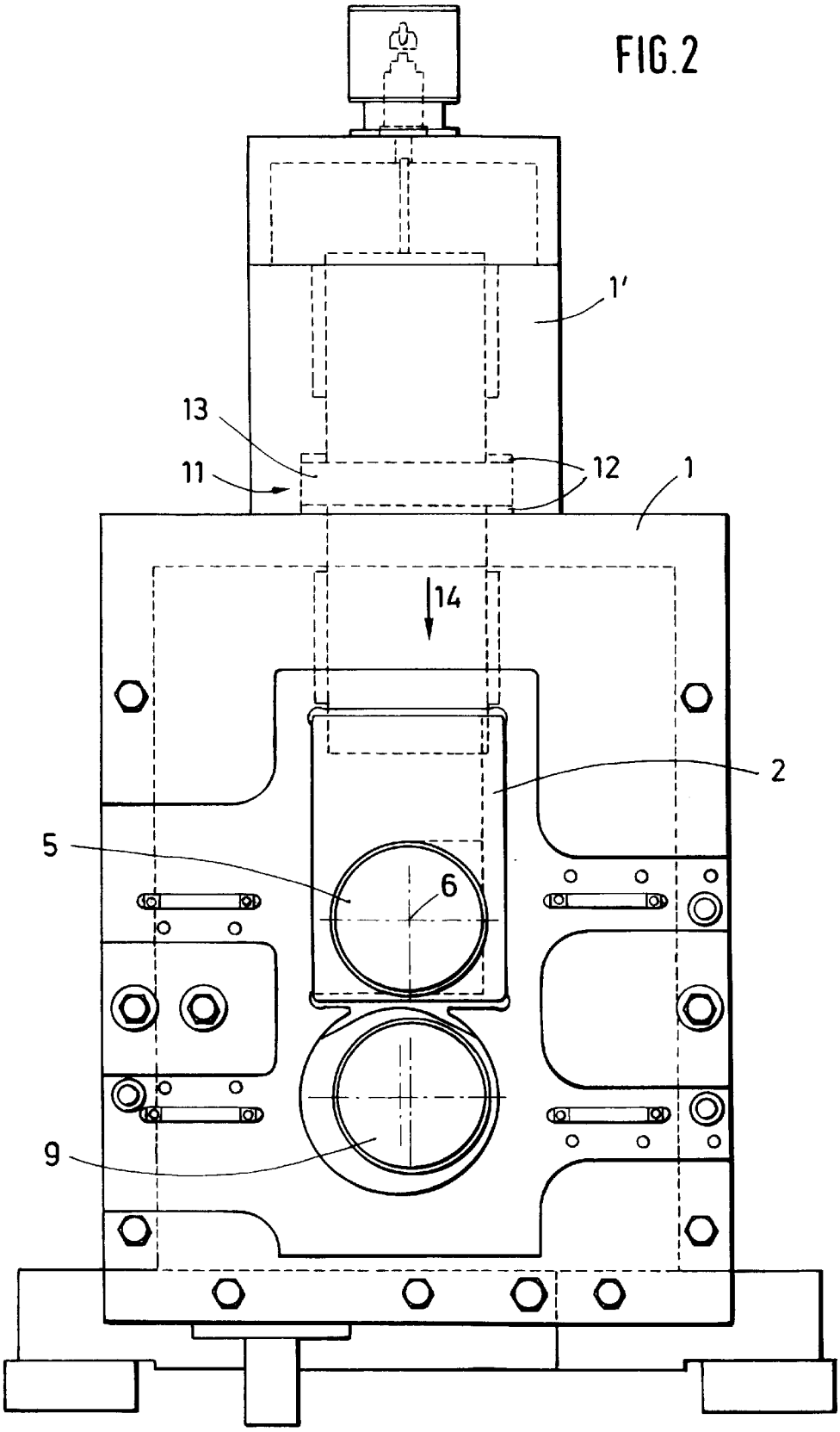
FIG. 2 shows a cross-sectional view of the stand shown in FIG. 1 along lines 2—2.
Figure 3:
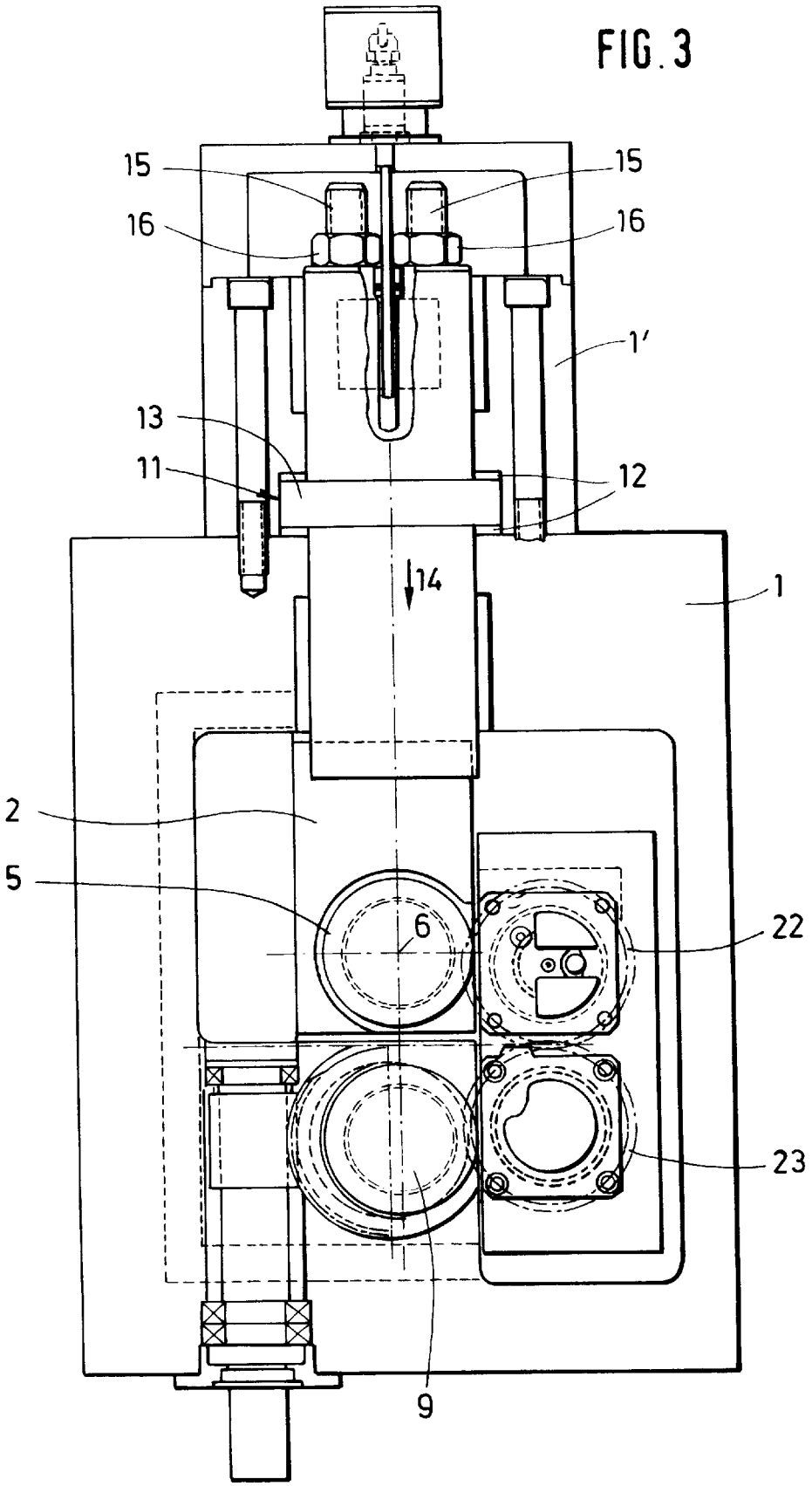
FIG. 3 shows a cross-sectional view of the stand shown in FIG. 1 along lines 3—3.

As shown in FIGS. 1 and 2, the chock 2 is supported in the frame 1 in the region of the roll-side bearing 3 transverse to the axis 6 and the adjustment direction 14 and without backlash.

The adjusting hydraulic cylinder unit 11 is provided adjacent to the roll-side bearing 3. Though the rolling mill stand can operate with a single adjusting hydraulic cylinder unit 11, the roll clearance between the disc rolls 7 and 10 can be adjusted much more precisely when an additional compensating hydraulic cylinder unit 18 with a cylinder 19 and a piston 20 is provided. The compensating hydraulic cylinder unit 18 is provided adjacent to the thrust bearing 4. As is the case with the adjusting hydraulic cylinder unit 11, the cylinder 19 of the compensating hydraulic cylinder unit 18 is connected with the frame 1, and the piston 20 is connected with the chock 2. Because the compensating hydraulic cylinder unit 18 should provide a smaller force than the adjusting hydraulic cylinder unit 11, it can be smaller than the adjusting hydraulic piston cylinder unit 11. Generally, the structure, attachment and operation of the compensating hydraulic cylinder unit 18 can be the same as those of the adjusting hydraulic cylinder unit 11.

Toothed wheels 21 are provided between respective bearing pairs 3–4 and 8 for driving the roll support shafts 5 and 7. The toothed wheel 21 of the support shaft 5 is directly engaged with a drive pinion 22. The drive pinion 22 further engages an intermediate pinion 23 which, in turn, is engaged with the other toothed wheel 21 of the further support shaft 9.

In the embodiment of the rolling mill stand shown in the drawings, the further support shaft 9 remains stationary in the frame 1. This is sufficient because the position of the support shaft 5 is adjustable, and roll clearance can be adjusted by adjusting the position of the support shaft 4 relative to the support shaft 9. However, generally, the further support shaft 9 can be mounted in a chock such as a chock 2. If the shaft 9 is also mounted in a chock, it would also become adjustable. Thereby, an almost completely symmetrical construction of the rolling mill stand can be obtained.

Though the present invention was shown and described with references to the preferred embodiments, various modifications thereof will be apparent to those skilled in the art and, therefore, it is not intended that the invention be limited to the disclosed embodiment or details thereof, and departure can be made therefrom within the spirit and scope of the appended claims.

What is claimed is:

1. A rolling mill stand for rolling wire, comprising:

a frame;

at least one chock mounted in the frame and having a roll-side bearing and a thrust bearing;

a roll support shaft supported in the roll-side bearing and the thrust bearing, the roll support shaft having a portion projecting outwardly past the roll-side bearing for supporting a roll thereon;

a further roll support shaft supported in the frame;

a hydraulic cylinder unit for adjusting the roll support shaft relative to the further roll support shaft in an adjusting direction and having a cylinder connected with the frame and a piston connected with the chock for displacement of the chock, together with the roll support shaft, relative to the frame, whereby a position of the roll support shaft relative to the further roll support shaft is adjusted; and means for releaseably connecting the piston with the chock.

2. A rolling mill stand as set forth in claim 1, wherein the releasably connecting means comprises at least one through-bore formed in the piston, at least one threaded bore provided in the chock and aligned with the through-bore of the piston, a dowel screw screwed into the threaded bore of the chock and projecting through the through-bore of the piston beyond the piston, and a nut screwed onto a projecting portion of the dowel screw.

3. A rolling mill stand as set forth in claim 1, further comprising a slide bearing provided in the frame on a side of the adjusting hydraulic cylinder unit adjacent to the chock for guiding the piston.

4. A rolling mill stand as set forth in claim 1, wherein the chock is supported in the frame in the region of the roll-side bearing transverse to an axis of the roll support shaft and transverse to the adjusting direction and without a backlash.

5. A rolling mill stand as set forth in claim 1, wherein the adjusting hydraulic cylinder unit is arranged adjacent to the roll-side bearing.

6. A rolling mill stand as set forth in claim 3, further comprising a further slide bearing for guiding the piston and provided in the frame on a side of the adjusting hydraulic cylinder unit remote from the chock.

7. A rolling mill stand for rolling wire, comprising:

a frame;

at least one chock mounted in the frame and having a roll-side bearing and a thrust bearing;

a roll support shaft supported in the roll-side bearing and the thrust bearing, the roll support shaft having a portion projecting outwardly past the roll-side bearing for supporting a roll thereon;

a further roll support shaft supported in the frame;

a hydraulic cylinder unit arranged adjacent to the roll-side bearing for adjusting the roll support shaft relative to the further roll support shaft in an adjusting direction and having a cylinder connected with the frame and a piston connected with the chock for displacement of the chock, together with the roll support shaft, relative to the frame, whereby a position of the roll support shaft relative to the further roll support shaft is adjusted; and a compensating hydraulic cylinder unit provided adjacent to the thrust bearing and having a cylinder connected with the frame and a piston connected with the chock.

8. A rolling mill stand as set forth in claim 7, wherein the compensating hydraulic cylinder unit has smaller dimensions than the adjusting hydraulic cylinder unit.

* * * * *